US008672050B2

(12) United States Patent
Baumann et al.

(10) Patent No.: US 8,672,050 B2
(45) Date of Patent: Mar. 18, 2014

(54) HAND-HELD POWER TOOL

(75) Inventors: Otto Baumann, Leinfelden-Echterdingen (DE); Christian Wiedemann, Tiefenbronn (DE); Hardy Schmid, Stuttgart (DE); Holger Frank, Pfullingen (DE); Frank Mueller, Deckenpfronn (DE); Roger Hahn, Neuhausen (DE)

(73) Assignee: Robert Bosch GmbH, Stuttgart (DE)

( * ) Notice: Subject to any disclaimer, the term of this patent is extended or adjusted under 35 U.S.C. 154(b) by 276 days.

(21) Appl. No.: 12/739,612

(22) PCT Filed: Sep. 3, 2008

(86) PCT No.: PCT/EP2008/061590
§ 371 (c)(1),
(2), (4) Date: Apr. 23, 2010

(87) PCT Pub. No.: WO2009/053139
PCT Pub. Date: Apr. 30, 2009

(65) Prior Publication Data

US 2010/0300717 A1 Dec. 2, 2010

(30) Foreign Application Priority Data

Oct. 23, 2007 (DE) ..... 10 2007 050 549

(51) Int. Cl.
*B25F 5/00* (2006.01)

(52) U.S. Cl.
USPC ..... 173/104; 173/201; 173/213; 173/216; 184/6.14

(58) Field of Classification Search
USPC ..... 173/104, 201, 213, 216, 212, 48, 109; 184/6.14, 64
See application file for complete search history.

(56) References Cited

U.S. PATENT DOCUMENTS

| | | | | | |
|---|---|---|---|---|---|
| 1,956,644 | A * | 5/1934 | Hamerly | 184/55.1 |
| 3,162,268 | A * | 12/1964 | Short | 184/5 |
| 3,774,700 | A * | 11/1973 | Shepherd | 173/203 |
| 4,183,414 | A * | 1/1980 | Tamai et al. | 173/118 |
| 4,403,679 | A * | 9/1983 | Snider | 184/64 |
| 5,450,925 | A * | 9/1995 | Smith et al. | 184/5 |
| 5,638,935 | A * | 6/1997 | Fehring | 192/105 B |
| 6,109,366 | A * | 8/2000 | Jansson et al. | 173/216 |
| 6,739,406 | B2 * | 5/2004 | Lebisch et al. | 173/213 |
| 7,032,683 | B2 * | 4/2006 | Hetcher et al. | 173/1 |
| 7,036,607 | B2 * | 5/2006 | Lebisch et al. | 173/109 |
| 7,410,009 | B2 * | 8/2008 | Hirayama et al. | 173/201 |
| 8,074,856 | B2 * | 12/2011 | Fukinuki et al. | 227/131 |
| 2003/0121683 | A1 | 7/2003 | Lebisch et al. | |
| 2006/0272836 | A1 | 12/2006 | Hirayama et al. | |

FOREIGN PATENT DOCUMENTS

| | | | |
|---|---|---|---|
| CN | 1532015 | A | 9/2004 |
| CN | 1872498 | A | 12/2006 |
| DE | 10001192 | A1 | 7/2001 |
| DE | 10045618 | A1 | 4/2002 |

(Continued)

*Primary Examiner* — Scott A. Smith

(74) *Attorney, Agent, or Firm* — Maginot, Moore & Beck

(57) ABSTRACT

The invention relates to a hand-held machine tool, particularly to a drill hammer and/or chisel hammer, having a hand-held machine tool housing and a transmission chamber with at least one transmission element arranged inside the hand-held machine tool housing. According to the invention, the hand-held machine tool includes a pressure equalization unit, provided for equalizing pressure in the transmission housing and serving at least partially for supporting the transmission element.

23 Claims, 2 Drawing Sheets

(56) References Cited

FOREIGN PATENT DOCUMENTS

| | | | |
|---|---|---|---|
| DE | 10045619 | C1 | 5/2002 |
| DE | 10145296 | A1 | 4/2003 |
| DE | 10294312 | T5 | 9/2004 |
| EP | 1728596 | A1 | 12/2006 |
| GB | 1181125 | A | 2/1970 |
| JP | 2006334725 | A | 12/2006 |
| RU | 2164854 | C1 | 4/2001 |
| SU | 1811994 | A1 | 4/1993 |

* cited by examiner

HAND-HELD POWER TOOL

CROSS-REFERENCE TO RELATED APPLICATION

This application is a 35 USC 371 application of PCT/EP2008/061590 filed on Sep. 3, 2008.

BACKGROUND OF THE INVENTION

1. Field of the Invention

The invention is based on a hand-held power tool.

2. Description of the Prior Art

A hand-held power tool embodied in the form of a rotary hammer and/or chisel hammer is already known, having a hand-held power tool housing and a transmission compartment that has at least one transmission element and is situated inside the hand-held power tool housing.

ADVANTAGES AND SUMMARY OF THE INVENTION

The invention is based on a hand-held power tool, in particular a rotary hammer and/or chisel hammer, having a hand-held power tool housing and a transmission compartment that has at least one transmission element and is situated inside the hand-held power tool housing.

According to one proposal, the hand-held power tool has a pressure compensation unit that is provided to achieve a pressure compensation in the transmission compartment and serves to at least partially support the transmission element. In this context, "provided" should in particular be understood to mean especially equipped and/or designed. In addition, a "transmission compartment" should in particular be understood to be a closed unit that is embodied as closed off from a surrounding region with regard to a gas exchange or air exchange, with the exception of the pressure compensation unit; a "surrounding region" should be understood to be a motor compartment and/or an intermediate housing compartment and/or a compartment outside of the hand-held power tool housing. The transmission compartment is provided to accommodate a transmission unit. The embodiment according to the invention makes it possible to achieve an advantageous pressure compensation and to prevent an undesirable excess pressure in the transmission compartment; the excess pressure in this case can build up due to a heating of components of the transmission unit during an extended operation of the hand-held power tool. In addition, a particularly compact embodiment of the hand-held power tool can be achieved in that the pressure compensation unit performs a combination of at least two functions—pressure compensation and support. In addition, based on a pressure compensation of the pressure compensation unit, an undesirable escape and/or exchange of lubricant such as bearing grease, etc. can be advantageously prevented at bearing points of the transmission unit, thus at least reducing a premature wear on individual parts of the transmission unit and/or motor unit and enabling an operability of the hand-held power tool over a longer period of time. Another advantage of the pressure compensation unit is that decreasing the undesirable excess pressure achieves an advantageous temperature decrease, particularly inside the transmission compartment. This can be achieved in a particularly advantageous way if the pressure compensation unit has at least one pressure compensation opening by means of which an excess pressure can be reduced.

In this case, the pressure compensation opening preferably at least partially connects the transmission compartment to the motor compartment, thus permitting an excess pressure in the transmission compartment to be reduced in a particularly advantageous way by allowing air to escape from the transmission compartment into the motor compartment.

According to another proposal, the pressure compensation opening is at least partially comprised of a pressure compensation conduit through which an excess pressure in a subregion or more precisely stated, in the transmission compartment, can be selectively discharged. The pressure compensation conduit is advantageously composed of a bore, thus permitting an implementation of the pressure compensation opening in a particularly simply designed fashion.

According to another proposal, the pressure compensation opening is embodied as at least partially tapered; in addition to an advantageous pressure compensation, at least one functional element can be situated inside the pressure compensation opening in a simply designed fashion. Preferably, the tapered pressure compensation opening is embodied as stepped for this purpose.

In another proposed embodiment of the invention, the hand-held power tool has a pin, which is situated at least partially between the transmission compartment and the motor compartment and is equipped with the pressure compensation opening. By means of this, the pressure compensation opening can be advantageously integrated in a particularly space-saving fashion into an already existing component of the hand-held power tool, e.g. if the pin is constituted by a bearing pin for supporting a transmission element and/or by other components deemed suitable by the person skilled in the art. In addition, the pressure compensation unit can be advantageously preinstalled in the pin during a manufacturing process of the hand-held power tool, thus advantageously achieving a production of the hand-held power tool that reduces assembly complexity and/or costs. Preferably, the pin is constituted by a part whose surface advantageously has an at least slight contact with a lubricant or, in a particularly advantageous embodiment, is entirely lubricant-free, thus avoiding an undesirable exchange of lubricants, at least to a large extent. To this end, the pin can protrude in at least one direction into a central region of the transmission compartment and/or the motor compartment, thus keeping lubricant deposits away from the pressure compensation opening.

According to another proposal, the pressure compensation unit has at least one gas-permeable separating element, thus advantageously preventing an undesirable exchange and/or escape of lubricant and simultaneously permitting a pressure compensation. In this context, a "gas-permeable separating element" should in particular be understood to be an element that has a permeability for gas, in particular for a pressure compensation, and preferably for fluids and/or solid substances such as lubricants, has a separating property that advantageously prevents a permeability.

A particularly inexpensive and preferably weight-saving gas-permeable separating element can be advantageously achieved if the gas-permeable separating element is constituted by a felt element. A "felt element" should in particular be understood to be an element composed of a nonwoven made of wool and/or other textile fibers.

If the gas-permeable separating element is situated at least partially inside the pressure compensation opening, it is possible to achieve an especially space-saving, particularly compact arrangement of the gas-permeable separating element inside the pressure compensation unit.

According to another proposal, the pressure compensation unit has at least one fixing element that is provided to fix the gas-permeable separating element inside the pressure compensation opening, as a result of which the gas-permeable separating element can be advantageously prevented from undesirably falling out.

Preferably, the fixing element is constituted by a sleeve, thus permitting a simply designed fixing of the gas-permeable separating element inside a stepped pressure compensation opening. Embodying the fixing element in the form of a sleeve also assures an advantageous gas-permeability inside the pressure compensation opening. The sleeve can be constituted by a clamping sleeve, e.g. a shear stress pin, thus advantageously enabling further savings in terms of parts, space, assembly complexity, and costs for fastening the sleeve.

BRIEF DESCRIPTION OF THE DRAWINGS

The invention will be described in further detail below in conjunction with the accompanying drawings, in which.

DESCRIPTION OF THE PREFERRED EMBODIMENT

Figure 1:
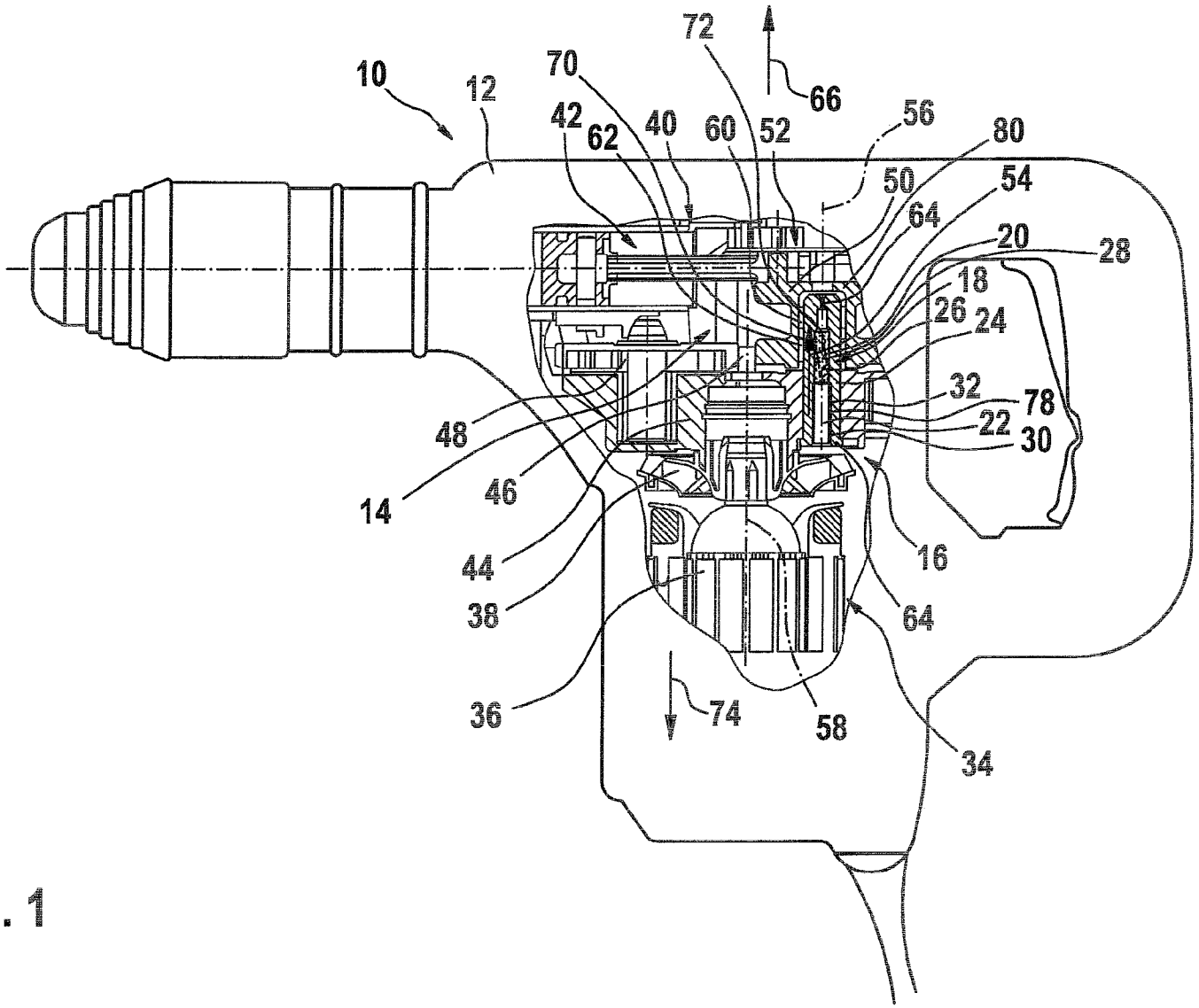
FIG. 1 is a schematic depiction of a hand-held power tool according to the invention, embodied in the form of a rotary hammer and equipped with a pressure compensation unit.
Figure 2:
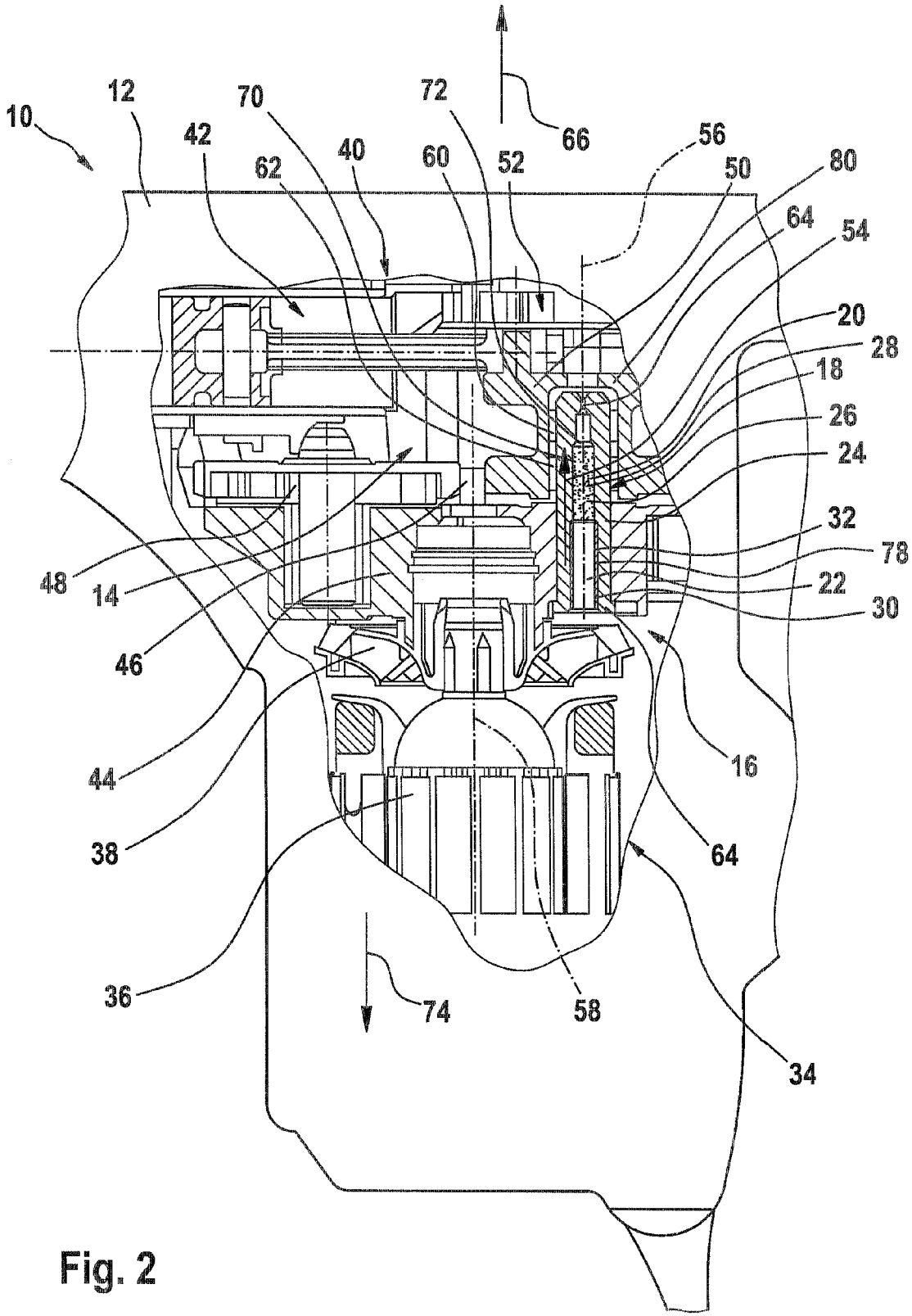
FIG. 2 is an enlarged schematic detail of the hand-held power tool equipped with the pressure compensation unit.

FIGS. 1 and 2 schematically depict a hand-held power tool 10 embodied in the form of a rotary hammer. The hand-held power tool 10 has a hand-held power tool housing 12, a transmission compartment 14 situated inside the hand-held power tool housing 12, and a motor compartment 16 situated inside the hand-held power tool housing 12. The motor compartment 16 has a motor unit 34, which includes an electric motor 36 and a fan 38, and the transmission compartment 14 has a transmission unit 40 equipped with an impact mechanism 42. In addition, the motor compartment 16 and the transmission compartment 14 are embodied as units that are separate from each other and are closed off from each other, preventing a gas exchange and a pressure compensation. For this purpose, the hand-held power tool 10 or more precisely stated, the hand-held power tool housing 12, has a bearing housing 44 for a separation of the transmission compartment 14 from the motor compartment 16; the bearing housing 44 is provided to support a motor shaft 46 of the motor unit 34 and to support transmission elements of the transmission unit 40 such as a ring gear 48 and an eccentric gear 50 of an eccentric unit 52. Instead of a bearing housing 44, it is essentially also conceivable in another embodiment to use a bearing flange and/or other components deemed suitable by a person skilled in the art to separate the transmission compartment 14 from the motor compartment 16. For a pressure compensation in the transmission compartment 14, the hand-held power tool 10 has a pressure compensation unit 18.

The bearing housing 44 has a pin 24 embodied in the form of a bearing pin that is press-fitted into the bearing housing 44. The pin 24 protrudes along the drive axis 58 of the motor unit 34 from the motor compartment 16 in the direction 66 toward the transmission compartment 14 and into the transmission compartment 14. A transmission element 80 comprised of the eccentric gear 50 of the transmission unit 40 is rotatably supported on the pin 24 and during operation, transmits the drive moment to the impact mechanism 42 in order to generate a hammering impulse for a tool that is not shown in detail. To this end, a main extension direction 54 of the pin 24 is oriented essentially parallel to a rotation axis 56 of the eccentric gear 50 and to the drive axis 58 of the motor shaft 46. In order to assure the lowest possible friction in the rotary motion of the eccentric gear 50 in relation to the pin 24, two needle bearings 60, 62 are situated between the eccentric gear 50 and the pin 24.

The pressure compensation unit 18 is situated in the pin 24 so that the pressure compensation unit is provided to support the transmission element 80. To this end, the pin 24 has a bore extending along its main extension direction 54, which is composed of a pressure compensation opening 20 embodied in the form of a pressure compensation conduit 22. The pressure compensation conduit 22 connects the transmission compartment 14 to the motor compartment 16 so that during operation of the hand-held held power tool 10, an excess pressure in the transmission compartment 14 can be discharged into the motor compartment 16 by means of the pressure compensation conduit 22. In addition, along the main extension direction 54 in the end regions 64 of the pressure compensation conduit 22 and pin 24, the pressure compensation conduit 22 has a wall with a 60° slope in relation to the main extension direction 54. The 60° slope simplifies a grinding process of the pressure compensation conduit 22 during a manufacture of the pin 24 together with the pressure compensation unit 18.

The pressure compensation conduit 22 is embodied as tapered, with a tapering extending along the main extension direction 54 from the motor compartment 16 in the direction 66 toward the transmission compartment 14. The tapering of the pressure compensation conduit 22 is embodied as stepped.

The pressure compensation unit 18 also has a gas-permeable separating element 26 and a fixing element 30 embodied in the form of a sleeve 32. The gas-permeable separating element 26 is composed of a cylindrical felt element 28; the cylindrical felt element 28 has a transverse span that is oriented essentially transverse to the main extension direction 54 of the pin 24 and corresponds/is equal to a transverse span or inner diameter of a stage 70 of the tapered pressure compensation conduit 22 situated in the middle in the main extension direction 54 of the pin 24. By means of this, a step-shaped shoulder 72 of the pressure compensation conduit 22 holds the cylindrical felt element 28 in position along the main extension direction 54 from the motor compartment 16 in a direction 66 toward the transmission compartment 14. A longitudinal span of the cylindrical felt element 28 oriented in the main extension direction 54 of the pin 24 corresponds to a longitudinal span of the middle stage 70.

In order to fix the cylindrical felt element 28 along the main extension direction 54 of the pin 24 from the transmission compartment 14 in a direction 74 toward the motor compartment 16, the sleeve 32, which is embodied in the form of a clamping sleeve such as a sheer stress pin, is situated inside the pressure compensation conduit 22 and clamped to the pin 24; the sleeve 32 is situated in the direction 74 toward the motor compartment 16 after the cylindrical felt element 28, in the region of a step 78 of the pressure compensation conduit 22 oriented toward the motor compartment. In addition, it is embodied with a material thickness that is thicker than a step height so that the cylindrical felt element 28 is secured in a way that prevents it from undesirably falling out in the direction 66 toward the motor compartment 16 and is securely fixed in the pressure compensation conduit 22.

During operation of the hand-held power tool 10, a rotation movement of transmission components and a production of a hammering impulse of the transmission unit 40 inside the transmission compartment 14 can lead to a heating of individual components of the transmission unit 40. This heating results in a heating of air inside the transmission compartment 14 and to an undesirable pressure increase or more precisely stated, an undesirable excess pressure. By means of the pressure compensation unit 18, it is possible to discharge the excess pressure from the transmission compartment 14 into the motor compartment 16 in the process of which warm air flows from the transmission compartment 14 through the pressure compensation opening 20 into the motor compartment 16.

Also during a pressure compensation by means of the pressure compensation opening 20 of the pressure compensation unit 18, an exchange or escape of lubricants through the pressure compensation conduit 22 is prevented by means of the cylindrical felt element 28. A rotation of the eccentric gear 50, which rotates around the pin 24 and therefore around the pressure compensation unit 18, produces a centrifugal force during operation of the hand-held power tool 10 that acts on lubricant possibly emerging in the vicinity of the eccentric gear 50 and removes the lubricant from the pressure compensation conduit 22, thus preventing to the greatest possible extent a lubricant exchange via the pressure compensation conduit 22. In addition, an arrangement of the pin 24 protruding far into the transmission compartment 14 impedes a contact of the pressure compensation conduit 22 with the lubricant and protects the pressure compensation conduit 22 from a possible entry of lubricants.

The foregoing relates to the preferred exemplary embodiments of the invention, it being understood that other variants and embodiments thereof are possible within the spirit and scope of the invention, the latter being defined by the appended claims.

The invention claimed is:

1. A hand-held power tool, in particular a rotary hammer and/or chisel hammer, comprising:

a hand-held power tool housing;

a transmission compartment, which has at least one transmission gear and which is situated inside the hand-held power tool housing, the at least one transmission gear defining a rotation axis about which the transmission gear rotates and including a bore extending along the rotation axis;

a pressure compensation unit that is provided for a pressure compensation in the transmission compartment and serves to at least partially support the transmission gear, wherein the pressure compensation unit is disposed at least partly in the bore; and a bearing disposed within the bore and adjacently located with and between the at least one transmission gear and the pressure compensation unit, wherein the at least one transmission gear is rotatably supported by the bearing.

2. The hand-held power tool as recited in claim 1, wherein the pressure compensation unit has at least one pressure compensation opening.

3. The hand-held power tool as recited in claim 2, wherein the pressure compensation opening at least partially connects the transmission compartment and a motor compartment.

4. The hand-held power tool as recited in claim 3, wherein the pressure compensation opening is at least partially composed of a pressure compensation conduit.

5. The hand-held power tool as recited in claim 3, wherein the pressure compensation opening is embodied as at least partially tapered.

6. The hand-held power tool as recited in claim 3, wherein the pressure compensation unit comprises a pin that has the pressure compensation opening and is situated at least partially between the transmission compartment and the motor compartment.

7. The hand-held power tool as recited in claim 2, wherein the pressure compensation opening is at least partially composed of a pressure compensation conduit.

8. The hand-held power tool as recited in claim 7, wherein the pressure compensation opening is embodied as at least partially tapered.

9. The hand-held power tool as recited in claim 8, wherein pressure compensation unit comprises a pin that has the pressure compensation opening and is situated at least partially between the transmission compartment and the motor compartment.

10. The hand-held power tool as recited in claim 2, wherein the pressure compensation opening is embodied as at least partially tapered.

11. The hand-held power tool as recited in claim 2, wherein the pressure compensation unit comprises a pin that has the pressure compensation opening and is situated at least partially between the transmission compartment and the motor compartment.

12. The hand-held power tool as recited in claim 1, wherein the pressure compensation unit has at least one gas-permeable separating element.

13. The hand-held power tool as recited in claim 12, wherein the gas-permeable separating element is embodied in the form of a felt element.

14. The hand-held power tool as recited in claim 13, wherein the gas-permeable separating element is situated at least partially inside the pressure compensation opening.

15. The hand-held power tool as recited in claim 13, wherein the pressure compensation unit has at least one fixing element that is provided to fix the gas-permeable separating element inside the pressure compensation opening.

16. The hand-held power tool as recited in claim 12, wherein the gas-permeable separating element is situated at least partially inside the pressure compensation opening.

17. The hand-held power tool as recited in claim 16, wherein the pressure compensation unit has at least one fixing element that is provided to fix the gas-permeable separating element inside the pressure compensation opening.

18. The hand-held power tool as recited in claim 17, wherein the fixing element is comprised of a sleeve.

19. The hand-held power tool as recited in claim 12, wherein the pressure compensation unit has at least one fixing element that is provided to fix the gas-permeable separating element inside the pressure compensation opening.

20. The hand-held power tool as recited in claim 19, wherein the fixing element is comprised of a sleeve.

21. The hand-held power tool as recited in claim 1, wherein the pressure compensation unit comprises a pressure compensation conduit.

22. The hand-held power tool as recited in claim 1, wherein the pressure compensation unit includes a pin extending from a motor compartment into the transmission compartment wherein the pin supports the bearing which rotatably supports the at least one transmission gear.

23. A hand-held power tool, in particular a rotary hammer and/or chisel hammer, comprising:

a hand-held power tool housing including a transmission compartment and a motor compartment;

a transmission gear situated inside the transmission compartment, the transmission gear defining a rotation axis about which the transmission gear rotates and including a bore extending along the rotation axis;

a pressure compensation unit configured to provide pressure compensation in the transmission compartment, the pressure compensation unit including a pin extending from the transmission compartment into the motor compartment, wherein the pin is disposed at least partly in the bore; and a bearing disposed within the bore and intermediately located between the transmission gear and the pin, the bearing in direct contact with and supported by the pin and the transmission gear in direct contact with the bearing and rotatably supported by the bearing.

* * * * *